US006711972B1

(12) United States Patent
Joyner et al.

(10) Patent No.: US 6,711,972 B1
(45) Date of Patent: Mar. 30, 2004

(54) ARTICULATED SUPPORT FOR MANUALLY-OPERATED TOOL

(75) Inventors: James E. Joyner, Wayne, MI (US); Michael G. Vitale, Saint Clair Shores, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 10/267,504

(22) Filed: Oct. 9, 2002

(51) Int. Cl.[7] ..... B25B 29/00
(52) U.S. Cl. ..... 81/57.4; 81/57.24
(58) Field of Search ..... 81/57.4, 57.24, 81/57.35

(56) References Cited

U.S. PATENT DOCUMENTS 285,484 A * 9/1883 Henley ..... 81/57.4
3,333,613 A * 8/1967 Bosse ..... 81/57.4
3,694,888 A * 10/1972 Bosse ..... 29/240
4,782,726 A * 11/1988 Ryder et al. ..... 81/57.4
5,544,554 A * 8/1996 Brightly ..... 81/57.4
5,580,021 A * 12/1996 Gillanders ..... 248/330.1
6,065,373 A * 5/2000 Watanabe et al. ..... 81/57.4

* cited by examiner

*Primary Examiner*—Joseph J. Hail, III
*Assistant Examiner*—David B. Thomas
(74) *Attorney, Agent, or Firm*—Brinks Hofer Gilson & Lione

(57) ABSTRACT

An articulated support for a manually-operated power tool, such as a manually-positioned and trigger-operated tool having a driven rotary spindle for engagement with a work, includes a plurality of elongated segments that are connected by articulating joints to thereby define several relative joint angles. Angle sensors at the joints generate relative angle information that is used by a controller to determine when the tool has been placed in a position, relative to either the support's fixed base or the work, in which a selected tool operation is likely to be performed successfully. Thereafter, the controller enables trigger-operation of the tool, monitors the length of time that the selected tool operation is performed, and, preferably, determines the likelihood of a successful completion of the operation based at least in part on the monitoring.

20 Claims, 3 Drawing Sheets

ARTICULATED SUPPORT FOR MANUALLY-OPERATED TOOL

FIELD OF INVENTION

The invention relates to an articulated support for manually-operated power tools, and a method for controlling the operation of such tools operation so as to enable one or more selected tool functions based upon a determined tool position.

BACKGROUND OF THE INVENTION

The prior art has recognized the desirability of making the operability of a manually-operated or "hand-held" power tool conditioned on the proper placement of the tool relative to a work. Thus, the prior art is replete with the use of normally-open contact-based "limit" or "proximity" switches on the tool that ensure that a given tool operation can be performed only when the working end of the tool is placed in direct physical contact with the face of the work. Other known systems include the use of noncontact proximity sensors, situated either on the tool itself or on an adjacent fixture, to similarly determine whether the tool has been properly positioned relative to the work prior to enabling a select tool function. Such switches or systems often enable/disable a selected tool function either directly, as through use of a mechanical interlock, or indirectly, as by interrupting the communication, for example, of either power or an enabling control signal to the tool.

Unfortunately, such prior art switches or systems may fail to detect a false enable signal, as when the working end of the tool is placed in contact with a wrong location on the work in such a way as to otherwise generate the requisite enable signal. As yet another example of a circumstance in which a false enable signal is generated, where the tool includes a rotary spindle supporting a socket for tightening a threaded fastener, a false enable signal is readily achieved when the socket is only partially seated on the head of the intended fastener, whereupon the tightening operation likely will fail to achieve a desired torque.

A further instance where difficulties arise in the prior art is when multiple operations are to be performed by the tool on a given work. For example, it may be desirable to tighten or "torque" a plurality of threaded fasteners on a given assembly at a single workstation, perhaps in a predetermined sequence. In order to ensure that each fastener is properly tightened by a manually-operated tool, the prior art has resorted to multiple-spindle tools that are capable of simultaneously driving all of the fasteners with a single tool placement, thereby reducing the likelihood that a desired torque has not been successfully applied to a given fastener by the tool operator. Unfortunately, such multiple spindle tools are significantly more expensive than single-spindle tools and, further, must be dimensionally adapted for each specific application in order to simultaneously torque each of the multiple fasteners, thereby further increasing tool costs and reducing assembly design flexibility. Such tools are also typically larger, heavier and, perhaps, less maneuverable than single-spindle counterparts.

Accordingly, what is needed is a system and method for use with a manually-operated power tool that enables a select tool function based upon a detected position of the tool relative to the work.

SUMMARY OF THE INVENTION

It is an object of the invention to provide an articulated support for a manually-operated power tool with which to enable at least one select tool function based upon the relative position of the articulated support's elongate segments.

It is also an object of the invention to provide an articulated support for a manually-operated power tool that is useful in monitoring whether each of a series of selected tool operations are successfully performed by a tool operator, and the sequence of such tool operations.

It is a further object of the invention to provide an articulated support for a manually-positioned power tool that conditions a select tool operation upon a proper positioning of the tool, by a tool operator, relative either to a fixed base or a given work.

Yet another object of the invention is to provide a method for operating a manually-operated power tool based upon a determined tool position.

In accordance with the invention, an articulated support is provided for a manually-operated power tool whose operation is characterized, when mounted on the articulated support, by movement of the tool to at least one predetermined tool position in which a selected tool operation is to be performed on a work. Under the invention, the articulated support includes a pair of rigid elongated segments connected end-to-end to form a joint permitting rotation of one segment relative to the other segment about a joint axis, whereby a joint angle is formed at the joint; and a first sensor generating a first output signal representative of a joint angle formed between the connected segments about the joint axis. The articulated support further includes a controller for the power tool receiving the first output signal, wherein the controller determines an indicated position for the tool based at least in part on the first output signal and enable the first operation of the tool when the indicated position is the predetermined tool position. An exemplary embodiment of the articulated support further includes a second sensor generating a second output signal representative of a base angle formed between the one segment and the base about the base axis, with the controller further determining the indicated position based on the second output signal. A proximity sensor can further be used to generate a third output signal representative of a distance achieved between one segment and one of the base and the work, with the controller further determining the indicated position based on the third output signal.

In accordance with an aspect of the invention, if the tool includes a trigger switch generating a trigger signal for triggering the selected operation, the controller preferably enables the selected operation in response to the trigger signal only when the indicated position is the predetermined position.

In accordance with another aspect of the invention, a method is provided for controlling a selected operation of a manually-operated tool that is supported relative to a fixed base by an articulated support mounted on the base, wherein the articulated support includes an arm formed by at least two rigid elongated segments connected end-to-end, and each adjacent pair of connected segments define a respective joint permitting rotation of one segment of each pair relative to the other segment of each pair about a respective joint axis. The method includes determining an indicated position for the tool relative to the base based at least in part on a relative joint angle formed between a pair of adjacent segments; and enabling the first tool operation when the indicated position of the tool is a predetermined position relative to the fixed base in which the first tool operation is to be performed. Under the method, determining the indicated position is preferably based upon the output signals generated by one or more angle sensors that are responsive to instantaneous angles formed between the base and the arm's first segment, or between an adjacent pair of connected segments.

In accordance with yet another aspect of the invention, the method may further preferably include determining whether the tool is within a predetermined proximity of a work, and enabling the first tool operation only when the indicated position of the tool is the predetermined position and the tool is within the predetermined proximity of the work. By way of example only, determining whether the tool is within the predetermined proximity of the work may include detecting a distance between a reference surface on the work and one of the tool and the support.

Also under the invention, a method for operating a power tool preferably includes determining an amount of time that the tool is substantially maintained in the predetermined position. The method further preferably includes comparing the determined amount of time that the tool is substantially maintained in the predetermined position with a predetermined minimum time period for completing the selected tool operation.

Additional benefits and advantages of the present invention will become apparent to those skilled in the art to which the present invention relates from the subsequent description of the preferred embodiment and the appended claims, taken in conjunction with the accompanying drawings.

DETAILED DESCRIPTION OF THE PREFERRED EMBODIMENT

Figure 1:
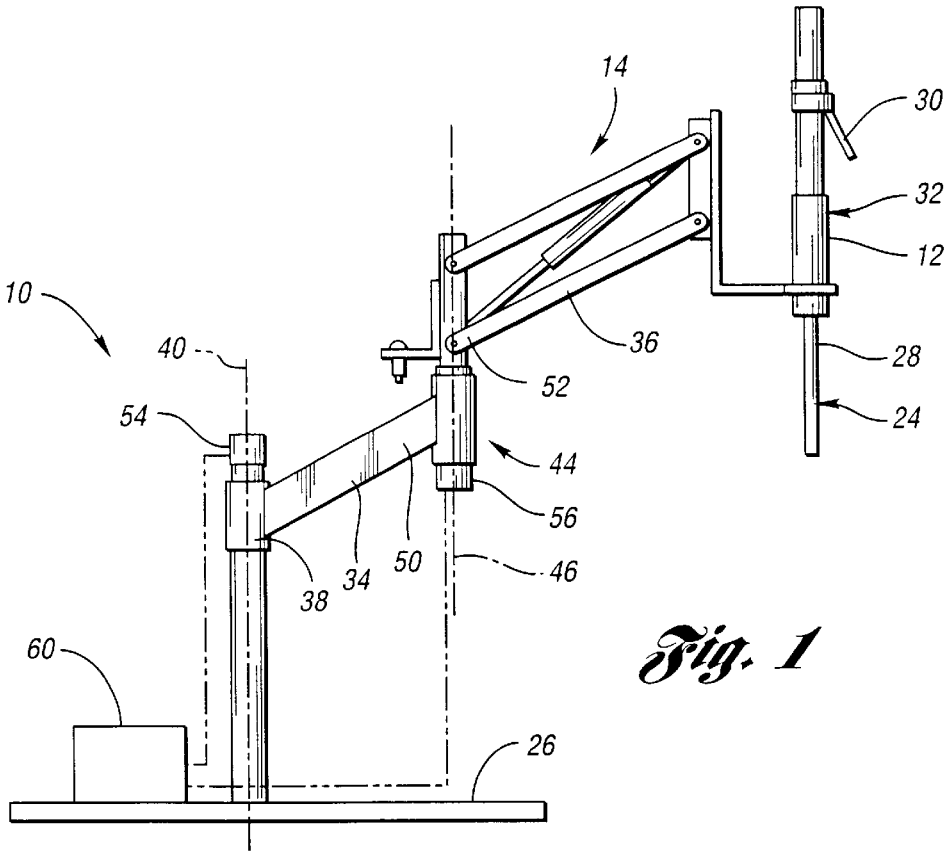
FIG. 1 is an elevational view of a workstation having a manually-operated rotary power tool mounted on an articulated support in accordance with the invention.

Referring to the Drawings, a workstation 10 includes a manually-operated power tool 12 mounted on an articulated support 14 such that the power tool 12 is movable from a rest position 18, away from a work 20, to at least a first operative position 22 characterized by the engagement of a working end 24 of the tool 12 with the work 20. In the context of the invention, a "manually-operated" power tool 12 is a tool having at least one intended or selected mode of operation in which the tool operator either manually initiates and/or continues the intended or selected operating mode, or manually positions and/or guides the tool 12 to one or more desired positions relative to either a fixed reference point (such as the base 26 of the articulated support 14) or the work 20, immediately before and/or during a selected tool operation. Thus, by way of example only, in the workstation 10, the working end 24 of the manually-operated power tool 12 includes a single spindle 28 that is driven by an electric motor (not shown) under the control of an operator-manipulated trigger switch 30, with the operator further controlling the precise placement of the tool's working end 24 via the tool's grips 32.

The articulated support 14 itself includes a plurality of generally rigid segments 34,36. The invention contemplates use of any suitable number of segments 34,36, deployed in any suitable configuration relative to the fixed base 26 to thereby obtain an articulated support 14 that provides the tool's working end 24 with a desired range of motion relative to both the base 26 and the work 20. Thus, by way of example only, in the exemplary workstation 10, the articulated support 14 includes a pair of generally elongate segments 34,36. An end 38 of the first segment 34 is mounted to the base 26 such that the first segment 24 is rotatable relative to the base 26 about a base axis 40 to thereby define a base angle 42.

Figure 2:
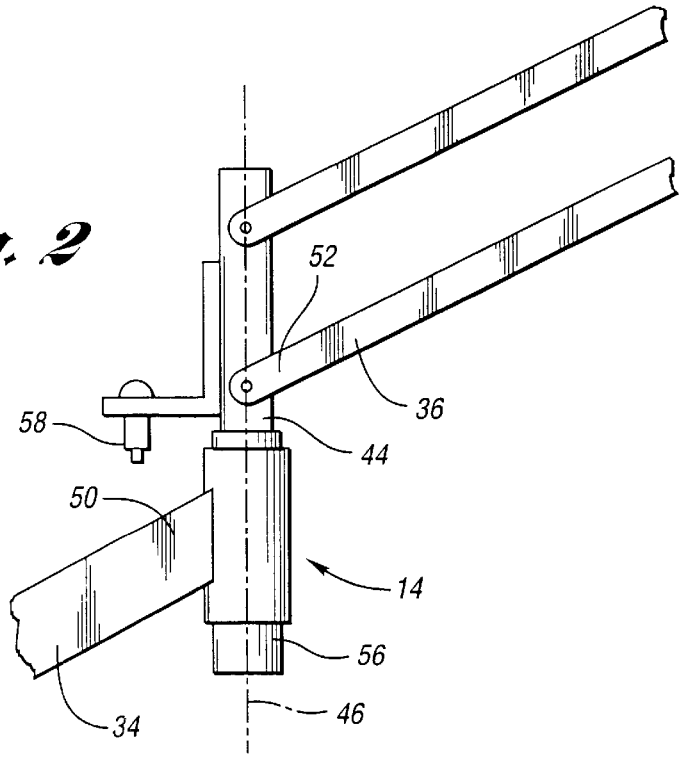
FIG. 2 is an enlarged view of an articulating joint between two segments of the articulated support.
Figure 3A:
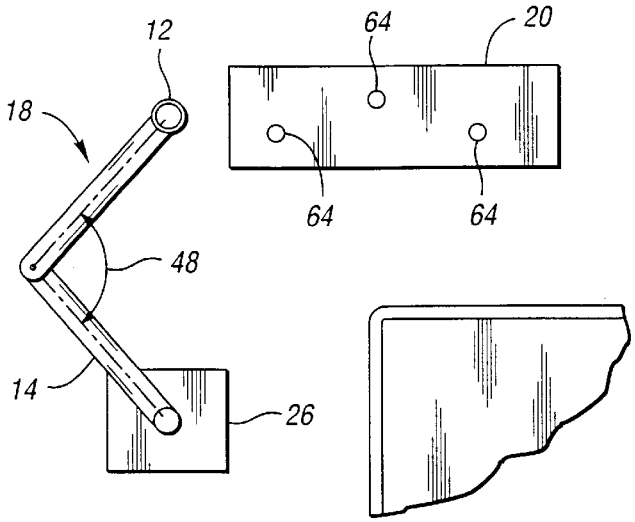
FIG. 3*a* is a diagrammatic plan view of the workstation with the articulated support in a rest position.

In accordance with the invention, each pair of adjacent segments 34,36 of the articulated support 14 are pivotally joined together to thereby define a plurality of movable or articulated joints 44, wherein each joint 44 permits the rotation of one segment 34 relative to the other segment 36 about a joint axis 46 so as to define a joint angle 48 between each such pair of adjacent segments 34,36. Thus, as best seen in FIGS. 2 and 3*a*, in the exemplary workstation 10, the second end 50 of the first segment 34 is joined with the first end 52 of the second segment 36 to thereby define the first segment joint 44 and the first joint angle 48. It will be appreciated that, if the articulated support 14 includes three segments, the resulting articulated support 14 will serve to define one base angle 42 and two joint angles 48.

In accordance with one aspect of the invention, as best seen in FIG. 1, the base angle 42 and, preferably, at least one joint angle 48 are each detected with a respective sensor 54,56 that generates an output signal representative of the instantaneous detected base and joint angles 42,48. By way of example only, a suitable sensor 54 is an absolute encoder device, such as a DuraCoder® encoder, part number DC25F-B1A4AS, sold by Advanced Micro Controls Inc., of Terryville, Conn. The sensors 54,56 may each have a similar resolution or, alternatively, the joint angle sensors 56 may have a greater resolution than the base angle sensor 54. Thus, in the exemplary workstation 10, the joint angle sensors 56 are 16-bit high resolution sensors, while the base angle sensor 54 is an 8-bit sensor.

In accordance with another aspect of the invention, as best seen in FIG. 2, a proximity sensor 58 is also mounted on the articulated support 14. The proximity sensor 58 generates an output signal when the articulated support 24 is positioned such that the tool 12 reaches within a predetermined minimum distance from the work 20. Although the proximity sensor 58 in the exemplary workstation 10 is used to supplement the position information afforded by the base and joint angle sensors 54,56, it will be appreciated that the proximity sensor can be used in lieu of one of the base angle sensor 54 or a joint angle sensor 56 if less resolution is required to achieve the desired tool operation.

Also as seen in FIG. 1, a controller 60 receives the several output signals generated by the sensors 54,56,58 and determines an instantaneous tool position based upon the sensor output signals. The controller 60 then compares the instantaneous tool position with a predetermined tool position, as retrieved from a storage register associated with the controller (not shown). When the controller 60 determines that the instantaneous tool position is the same as, or substantially the same as, the predetermined position, the controller 60 enables a selected tool function, for example, by supplying power to the tool's trigger switch 30, whereupon the tool operation can be manually performed by a tool operator. Alternatively, if an operator has already requested the selected tool operation as by pulling the trigger switch 30, the controller 60 can itself initiate the selected tool operation once the tool 12 is placed in the proper position. It will be appreciated that, in the context of the invention, the term "position" means a relative or absolute location of the tool 12 in one or more physical dimensions, as well as a relative or absolute tool orientation about a predetermined tool axis (not shown).

Figure 3B:
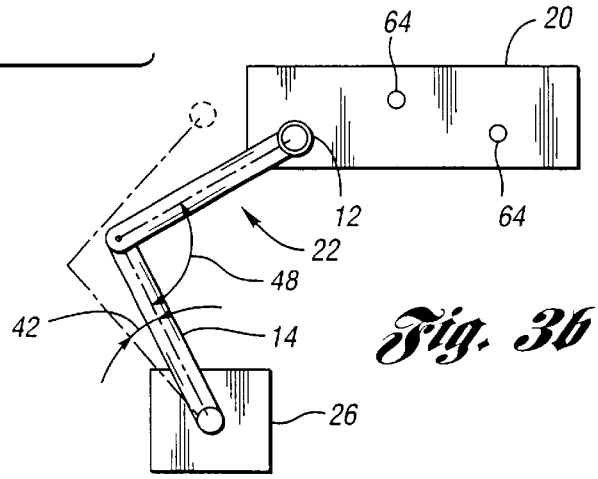
FIGS. 3*b* and 3*c* are diagrammatic plan views illustrating the articulated support positioned into each of two predetermined positions in which a selected tool operation is to be repeated, with the rest position of the articulated support of FIG. 3*a* being shown in broken lines to illustrate the resulting base and joint angles.
Figure 3C:
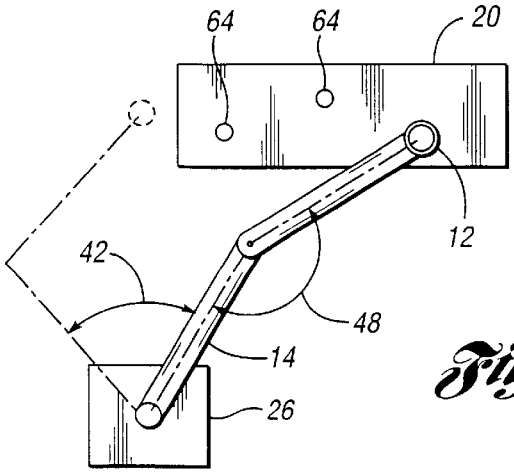
Figure 4A:
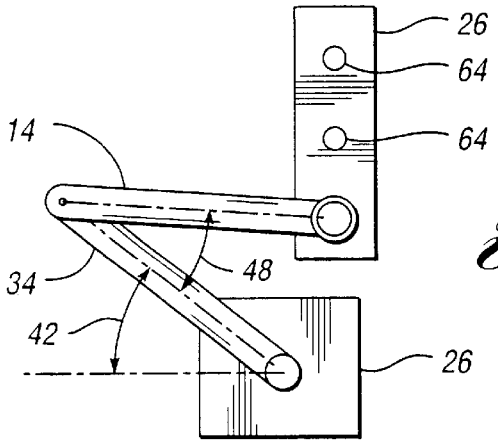
FIGS. 4*a*–4*c* are another series of diagrammatic plan views illustrating the positioning of the articulated support into each of three additional predetermined positions in which the selected tool operation is to be performed, wherein each of the three additional predetermined positions are characterized by an identical base angle but different joint angles.
Figure 4B:
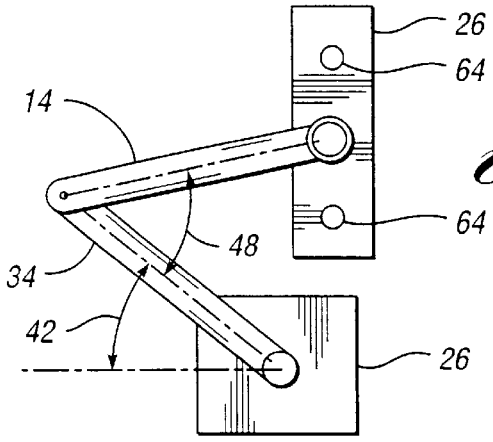
Figure 4C:
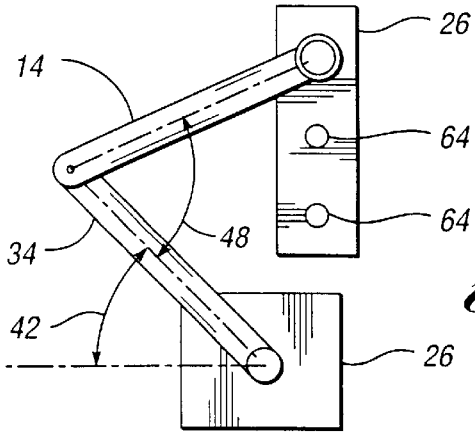

FIGS. 3*a*–3*c* illustrate the articulated support 14 moving from a rest position (illustrated in FIG. 3*a*) to each of two different operative positions (illustrated in FIGS. 3*b* and 3*c*), wherein the rest and operative positions are respectively characterized by a unique base angle 42 and a unique joint angle 48. FIGS. 4*a*–4*c* illustrate the articulated support 14 moving from the identical rest position (illustrated in FIG. 4*a*) to a plurality of different operative positions (illustrated in FIGS. 4*b* and 4*c*), wherein the operative positions each define the same, or substantially the same, base angle 42, and respectively unique joint angles 48. In this manner, the operation of the articulated support 14 as illustrated in FIGS. 4*a*–4*c* may present an opportunity to achieve cost savings by employing a relatively lower resolution base angle sensor 54 or, perhaps, even employ one or more limit switches (not shown) to identify movement of the first segment 34 from a rest position to one of the operative positions.

The invention advantageously permits the support-mounted tool 12 to be used with greater accuracy and confidence with respect to the selected tool operation. For example, in the exemplary workstation 10, where the support-mounted tool 12 is a rotary spindle tool used to torque several cylinder head bolts as the cylinder head assemblies are advanced through the workstation 10, the invention advantageously ensures that the tool's working end 24 is properly positioned on each of the fastener locations 64 before the tool 12 is operated. Specifically, trigger-based operational control of the tool 12 is enabled for each of the several fasteners only after the controller 60 confirms that the tool 12 has been properly positioned with respect to each such fastener location 64. Thus, if the operator pulls the trigger switch 30 before the tool 12 is properly positioned, the selected operation will not be performed. Instead, in such circumstances, the tool 12 must be moved to the proper position and the trigger switch 30 must be pulled a second time in order to commence the selected tool operation.

Further, in accordance with another aspect of the invention, the controller 60 preferably monitors the period of time during which the operator performs the selected tool operation while the tool 12 is maintained in a predetermined relationship with the work 20, thereby facilitating quality control of the resulting assembly. The tool's operating time is also preferably stored in an appropriate memory location of an associated storage medium for suitable analysis. The period of time may also be compared, in real time, to a predetermined minimum time period in order to characterize the likely effectiveness of the operation in real time. Thus, by way of example only, if a selected tool operation fails to exceed the predetermined minimum time period believed to be required to successfully complete the selected tool operation, the controller 60 issues a warning signal to the tool operator, perhaps signaling the operator to repeat the operation.

Alternatively, in the event that a selected tool operation fails to exceed the predetermined minimum time period necessary for successful completion, the controller 60 signals the operator that the selected operation has failed and, for example, instructs the operator to trigger a clamp (not shown) on the articulated support 14 and to thereafter transfer the work to a "reject bin 66" (shown in partial plan view in FIG. 3*a* only). It will be appreciated that the controller 60 can monitor the output signals generated by the sensors 54,56,58 to confirm the subsequent movement of the work 20 into the reject bin 66. A proximity switch 68 on the reject bin 66, for example, is thereafter advantageously used to trigger the release of the work 20 from the clamp as the work 20 is positioned relative to the reject bin 66, thereby further ensuring that the work 20 has been removed from the line.

While the above description constitutes the preferred embodiment, it will be appreciated that the invention is susceptible to modification, variation and change without departing from the proper scope and fair meaning of the subjoined claims. For example, while the exemplary workstation 10 employs a rotary spindle tool, it will be appreciated that the articulated support and operating method of the invention are suitable for a variety of other uses characterized by a supported, manually-operated tool, including such uses as soldering equipment, circuit board wiring, and potting tools.

We claim:

1. An articulated support for a manually-operated power tool, wherein the tool, when mounted on the articulated support, is movable to at least one predetermined tool position in which a selected tool operation is to be performed on a work, the articulated support comprising:

a pair of rigid elongated segments connected end-to-end to form a joint permitting rotation of one segment relative to the other segment about a joint axis, whereby a joint angle is formed at the joint;

a first sensor generating a first output signal representative of a joint angle formed between the connected segments about the joint axis; and a controller for the power tool receiving the first output signal, wherein the controller determines an indicated position for the tool based at least in part on the first output signal and enables the first operation of the tool when the indicated position is the predetermined tool position.

2. The articulated support of claim 1, wherein one segment is pivotally mounted to a fixed based for movement about a base axis, and wherein the predetermined tool position is established relative to the base.

3. The articulated support of claim 2, further including a second sensor generating a second output signal representative of a base angle formed between the one segment and the base about the base axis; and wherein the controller further determines the indicated position based on the second output signal.

4. The articulated support of claim 1, further including a proximity sensor generating a third output signal representative of a distance achieved between one segment and one of the base and the work; and wherein the controller further determines the indicated position based on the third output signal.

5. The articulated support of claim 1, wherein the tool includes a trigger switch generating a trigger signal for triggering the selected operation, and wherein the controller enables the selected operation in response to the trigger signal only when the indicated position is the predetermined position.

6. An articulated support for a power tool, the tool being adapted to be manually positioned relative to a first predetermined tool position in which a selected tool operation is to be performed on a work, the support comprising:

a base;

a plurality of rigid elongated segments connected end-to-end, wherein an end of a first segment is pivotally mounted on the base for movement about a base axis, and wherein each adjacent pair of connected segments forms a respective joint permitting rotation of one segment of each pair relative to the other segment of each pair about a respective joint axis;

means for generating an output signal representative of an instantaneous position of the first segment relative to one of the base and an instantaneous joint angle formed between the connected segments of one of the joints; and a controller determining an indicated position for the tool based at least in part on the sensor output signal and enabling the selected tool operation when the indicated position is the first predetermined tool position.

7. The articulated support of claim 6, wherein the means for generating the output signal is a joint angle sensor on the articulated support, and the output signal is representative of the instantaneous joint angle.

8. The articulated support of claim 6, wherein the means for generating the output signal is a base angle sensor, the output signal being representative of an instantaneous base angle formed between the base and the first segment about the base axis.

9. The articulated support of claim 6, wherein the predetermined tool position is determined relative to the base.

10. The articulated support of claim 6, including a proximity sensor generating a second output signal representative of a distance achieved between one segment and one of the base and the work; and wherein the controller further determines the indicated position based on the second output signal.

11. The articulated support of claim 6, wherein the tool is adapted to be positioned relative to the fixed base to a second predetermined tool position in which the selected tool operation is to be performed on the work; and wherein the controller enables the selected tool operation when the indicated position is the second predetermined tool position.

12. A method for controlling a selected operation of a manually-operated tool that is supported relative to a fixed base by an articulated support mounted on the base, the articulated support including an arm formed by at least two rigid elongated segments connected end-to-end, each adjacent pair of connected segments defining a respective joint permitting rotation of one segment of each pair relative to the other segment of each pair about a respective joint axis, the method including:

determining an indicated position for the tool relative to the base based at least in part on a relative joint angle formed between a pair of adjacent segments; and enabling the selected operation when the indicated position of the tool is a predetermined position relative to the fixed base.

13. The method of claim 12, wherein determining includes detecting a relative base angle formed between the base and a first segment.

14. The method of claim 12, wherein determining includes detecting the relative joint angle formed between a pair of adjacent segments.

15. The method of claim 12, further including determining whether the tool is within a predetermined proximity of a work, and enabling the selected operation only when the indicated position of the tool is the predetermined position and the tool is within the predetermined proximity of the work.

16. The method of claim 15, wherein determining whether the tool is within the predetermined proximity of the work includes detecting a distance between a reference surface on the work and one of the tool and the articulated support.

17. The method of claim 12, wherein enabling includes comparing the indicated position to the predetermined position over a first predetermined time interval, and enabling the selected operation only after the indicated position is the predetermined position throughout the first predetermined time interval.

18. The method of claim 12, including determining an amount of time that the tool is substantially maintained in the predetermined position.

19. The method of claim 18, further including comparing the determined amount of time that the tool is substantially maintained in the predetermined position with a minimum time period for completing the selected tool operation.

20. The method of claim 12, wherein the tool includes a trigger switch, and wherein enabling includes supplying power to the trigger switch.

* * * * *